US007305979B1

(12) United States Patent
Yehle

(10) Patent No.: US 7,305,979 B1
(45) Date of Patent: Dec. 11, 2007

(54) DUAL-CAM ARCHERY BOW WITH SIMULTANEOUS POWER CABLE TAKE-UP AND LET-OUT

(76) Inventor: Craig T. Yehle, 1820 Yew Ct., Junction City, OR (US) 97448

( * ) Notice: Subject to any disclaimer, the term of this patent is extended or adjusted under 35 U.S.C. 154(b) by 19 days.

(21) Appl. No.: 11/084,395

(22) Filed: Mar. 18, 2005

(51) Int. Cl.
*F41B 5/10* (2006.01)

(52) U.S. Cl. ..... 124/25.6

(58) Field of Classification Search ..... 124/25.6, 124/900

See application file for complete search history.

(56) References Cited

U.S. PATENT DOCUMENTS 3,990,425 A 11/1976 Ketchum
5,368,006 A * 11/1994 McPherson ..... 124/25.6
5,505,185 A * 4/1996 Miller ..... 124/25.6
6,082,347 A * 7/2000 Darlington ..... 124/25.6
6,443,139 B1 * 9/2002 McPherson ..... 124/25.6
6,688,295 B1 * 2/2004 Miller ..... 124/25.3
6,691,692 B1 * 2/2004 Adkins ..... 124/25.6
6,990,970 B1 1/2006 Darlington

* cited by examiner

*Primary Examiner*—John A. Ricci
(74) *Attorney, Agent, or Firm*—David S. Alavi

(57) ABSTRACT

A cam assembly for an archery bow comprises: a journal for letting out a draw cable as the bow is drawn and the cam assembly rotates; a take-up mechanism for taking up a first power cable; and a let-out mechanism for letting out a second power cable. A second similar cam assembly comprises: a journal for letting out the draw cable; a take-up mechanism for taking up the second power cable; and a let-out mechanism for letting out the first power cable. Draw force versus draw distance for the bow is at least in part determined by: relative rates of take-up and let-out of the first power cable by the first and second cam assemblies, respectively; and relative rates of take-up and let-out of the second power cable by the second and first cam assemblies, respectively.

22 Claims, 9 Drawing Sheets

DUAL-CAM ARCHERY BOW WITH SIMULTANEOUS POWER CABLE TAKE-UP AND LET-OUT

BACKGROUND

The field of the present invention relates to archery bows. In particular, a dual cam archery bow is described herein wherein each power cable is simultaneously taken up at one end and let out at the other.

An exemplary prior-art dual-cam archery bow 10 is schematically illustrated in FIG. 1. Bow limbs 111*a* and 111*b* extend oppositely from handle 110. Cam assemblies 130*a* and 130*b* are rotatably mounted on limbs 111*a* and 111*b*, respectively. The cam assemblies are typically mirror images of one another. Draw cable 140 is secured at each end to the cam assemblies 130*a* and 130*b* and received in respective draw cable journals thereof. When the bow is drawn, the draw cable unwinds from the draw cable journals, thereby rotating the cam assemblies. A first power cable 145*a* is secured to the first cam assembly 130*a* and received in a power cable journal thereof, so that as the bow is drawn and the cam assembly 130*a* rotates, the power cable 145*a* is taken up. The other end of power cable 145*a* is secured to bow limb 111*b*, so that as the power cable 145*a* is taken up by the cam assembly 130*a*, the bow limbs are drawn toward one another. In an analogous fashion, power cable 145*b* is secured at one end to cam assembly 130*b* and received in a power cable journal thereof and is taken up when the bow is drawn, and is secured at its other end to bow limb 111*a*. The geometric profiles of the draw cable journals and the power cable journals determine the draw force versus draw distance for the bow. The cam assemblies are typically configured to yield a decrease in draw force near full draw (referred to as the "let-off"; typically expressed as a percentage decrease in draw force from the peak draw force). Relatively larger let-off is deemed desirable in the industry (greater than 65% reduction in draw force is deemed desirable, for example), as is increasing energy stored by the bow at full draw for a given amount of rotation of the cam assembly. For optimal bow performance, substantial synchronization of rotation of the cams is required, but often problematic to achieve in practice.

In prior art bows, the first end of each power cable is secured to a cam assembly, while the second end is secured directly to the other bow limb. (For this reason, such a power cable is sometimes referred to as an anchor cable.) Difficulties encountered in prior art bow designs may be at least partially mitigated by securing the second end of each power cable to the other cam assembly, as is disclosed hereinbelow.

SUMMARY

An archery bow comprises: a central handle portion; a first flexible bow limb and a second flexible bow limb, first and second cam assemblies, a draw cable, and first and second power cables. The first and second bow limbs are mounted on and project oppositely and substantially symmetrically from the handle. The first and second cam assemblies are each rotatably mounted on the first and second bow limbs, respectively, and each comprise a draw cable journal, a power cable take-up mechanism, and a power cable let-out mechanism. The draw cable is secured at a first end thereof to the first cam assembly and received in the draw cable journal thereof, and is secured at a second end thereof to the second cam assembly and received in the draw cable journal thereof. The first power cable is secured at a first end thereof to the first cam assembly and engaged with the power cable take-up mechanism thereof, and is secured at a second end thereof to the second cam assembly and engaged with the power cable let-out mechanism thereof. The second power cable is secured at a first end thereof to the second cam assembly and engaged with the power cable take-up mechanism thereof, and is secured at a second end thereof to the first cam assembly and engaged with the power cable let-out mechanism thereof. The first and second cam assemblies are arranged so that drawing the bow results in: i) the draw cable being let out from the respective draw cable journals of the first and second cam assemblies, ii) rotation of the first and second cam assemblies, iii) the first end of the first power cable being taken up by the power cable take-up mechanism of the first cam assembly and the second end of the first power cable being let out by the power cable let-out mechanism of the second cam assembly, and iv) the first end of the second power cable being taken up by the power cable take-up mechanism of the second cam assembly and the second end of the second power cable being let out by the power cable let-out mechanism of the first cam assembly.

Objects and advantages pertaining to dual-cam archery bows may become apparent upon referring to the exemplary embodiments illustrated in the drawings and disclosed in the following written description or claims.

The embodiments shown in the Figures are exemplary, and should not be construed as limiting the scope of the present disclosure or appended claims. The Figures may illustrate the exemplary embodiments in a schematic fashion, and various shapes, sizes, angles, curves, proportions, and so forth may be distorted to facilitate illustration. The specific shapes, sizes, angles, curves, proportions, etc should not be construed as limiting the scope of the present disclosure or appended claims.

DETAILED DESCRIPTION OF EMBODIMENTS

Figure 2:
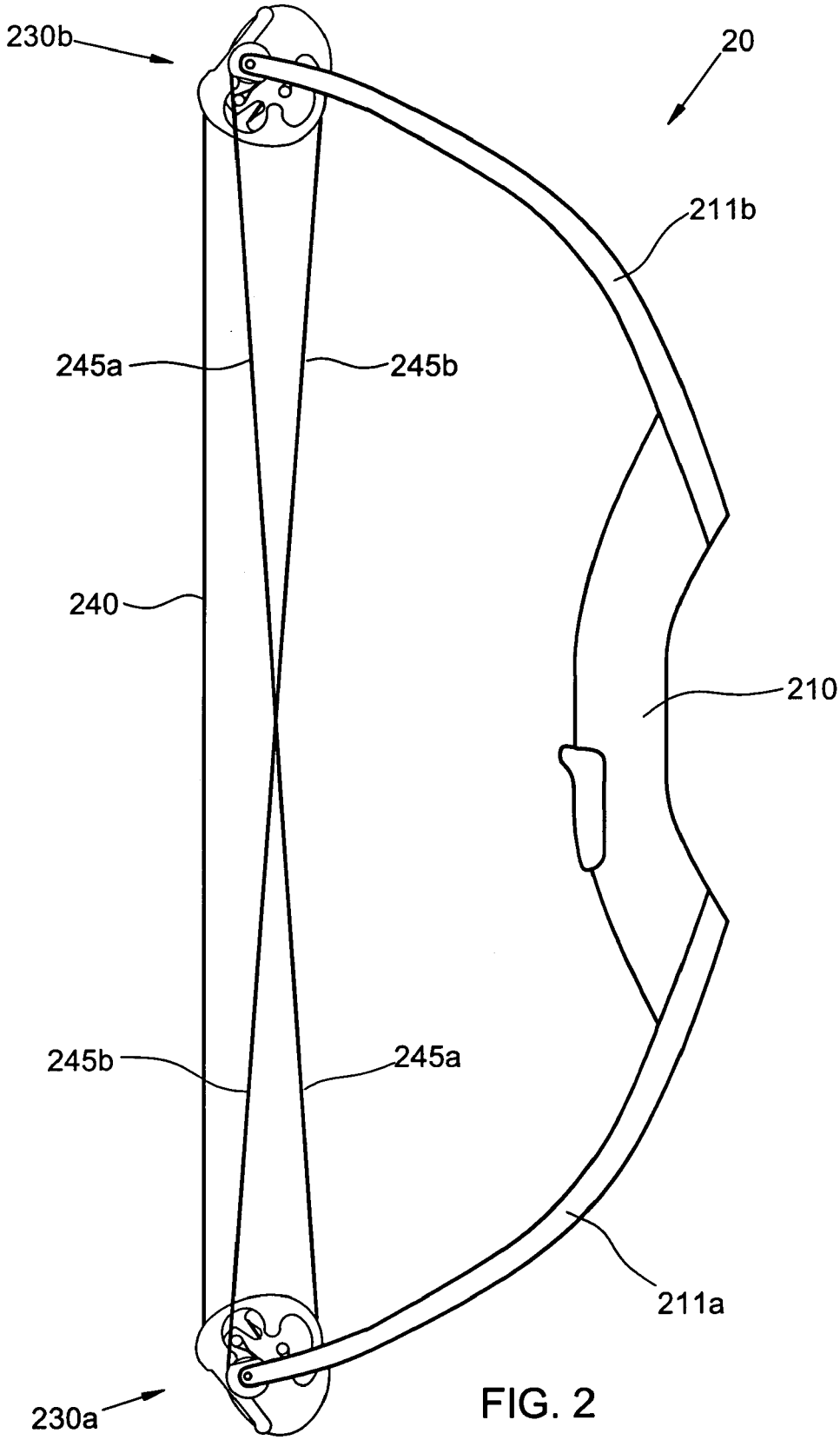
FIG. 2 schematically illustrates a dual-cam archery bow with each power cable secured at one end to a cam assembly and at the other end to another cam assembly.

An exemplary cable-synchronized dual-cam archery bow 20 is schematically illustrated in FIG. 2. The cam assemblies are shown enlarged in FIGS. 3A and 4A at brace (i.e., prior to drawing the bow), and in FIGS. 3B and 4B at full draw. Bow limbs 1*a* and 211*b* extend oppositely from handle 210. Cam assemblies 230*a* and 230*b* are rotatably mounted, typically eccentrically, on respective limbs 211*a* and 211*b* on respective axles 212*a* and 212*b*. Both eccentrically and concentrically mounted cams shall fall within the scope of the present disclosure or appended claims. The cam assemblies are typically mirror images of one another (symmetric cams), though this need not always be the case. Both symmetric and asymmetric embodiments shall fall within the scope of the present disclosure or appended claims. Draw cable 240 is secured at each end to the cam assemblies 230*a* and 230*b* and received in respective draw cable journals 232*a* and 232*b* thereof. When the bow is drawn, the draw cable unwinds from the draw cable journals, thereby rotating the cam assemblies. A first power cable 245*a* is secured to the first cam assembly 230*a* and engaged with a power cable take-up mechanism thereof, so that as the bow is drawn and the cam assembly 230*a* rotates, the power cable 245*a* is taken up by cam assembly 230*a*. The other end of power cable 245*a* is secured to cam assembly 230*b* and engaged with a power cable let-out mechanism thereof, so that as the bow is drawn and cam assembly 230*b* rotates, power cable 245*a* is let out by cam assembly 230*b*. The power cable take-up mechanism of cam assembly 230*a* and the power cable let-out mechanism of cam assembly 230*b* are arranged so that as the bow is drawn, the bow limbs are drawn toward one another. In an analogous fashion, power cable 245*b* is secured at one end to cam assembly 230*b*, engaged with a power cable take-up mechanism thereof, and is taken up when the bow is drawn, while its other end is secured to cam assembly 230*a*, engaged with a power cable let-out mechanism thereof, and is let out when the bow is drawn. The draw force versus draw distance for the bow is determined at least in part by: the relative rates of take-up and let-out of the first power cable by the first and second cam assemblies, respectively; and the relative rates of take-up and let-out of the second power cable by the second and first cam assemblies, respectively. The power cables are typically held out of the arrow path by a cable guard (not shown).

Figure 1:
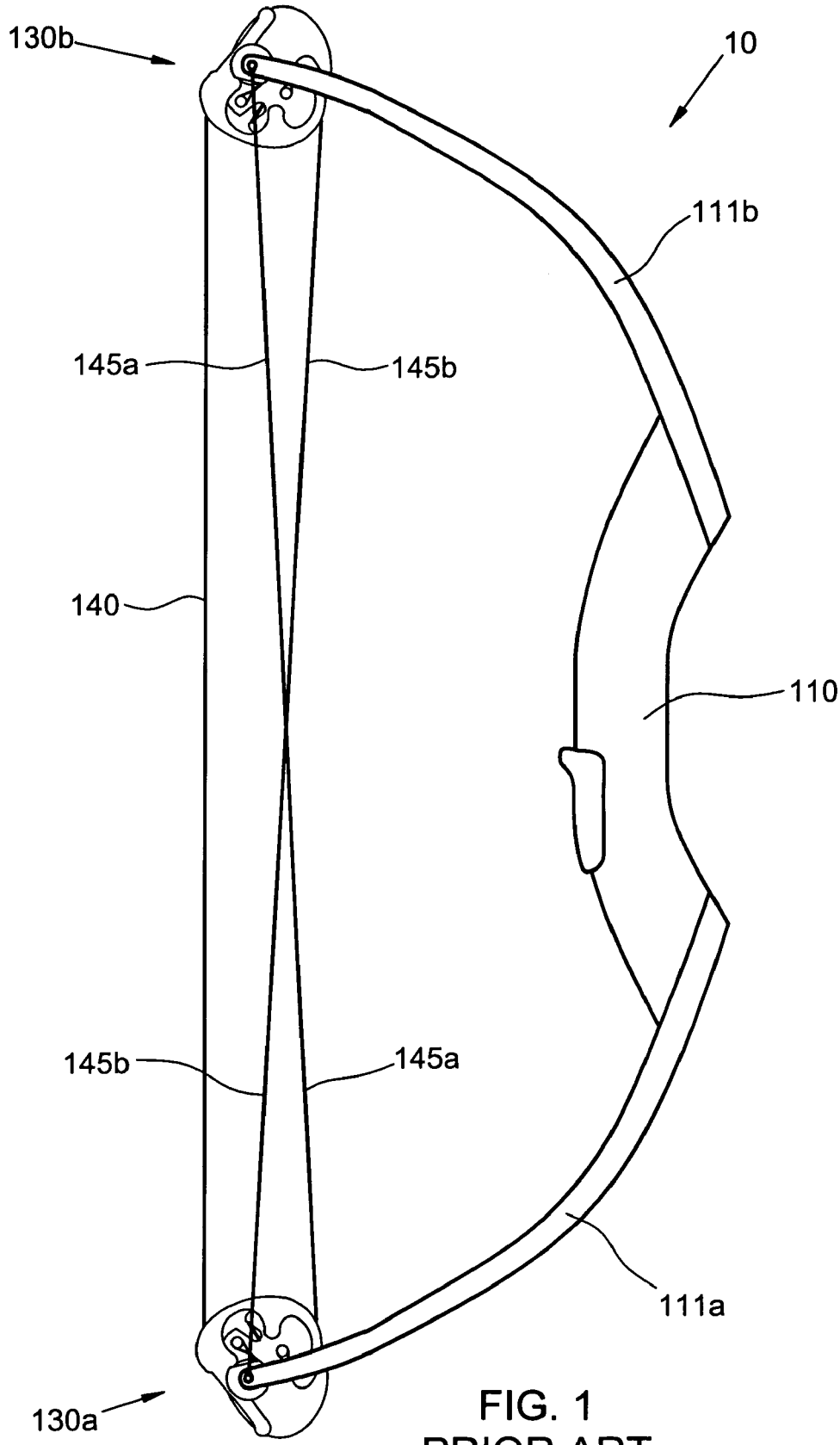
FIG. 1 PRIOR ART
FIG. 1 schematically illustrates a prior-art dual-cam archery bow with each power cable secured at one end to a cam assembly and at the other end to a bow limb.

Paired cam assemblies 230*a* and 230*b* are shown in FIGS. 3A, 3B, 4A, and 4B. The power cable take-up mechanisms are shown as power cable take-up journals 234*a* and 234*b*, while the power cable let-out mechanisms are shown as power cable let-out journals 236*a* and 236*b*. The geometric profiles of these power cable journals, as well as the geometric profile of the draw cable journals 232*a* and 232*b*, together determine at least in part the draw force versus draw distance for the bow (i.e., a "draw force curve"). In the prior art bow of FIG. 1, only the rate of let-out of the draw cable and the rate of take-up of the power cable(s) can be manipulated to alter the draw force curve. In the bow of FIG. 2, both take-up of the first ends of the power cables and let-out at the other ends can be manipulated, along with let-out of the draw cable, to yield a desired draw force curve. With this additional degree of design flexibility, for example, it may be possible to generate greater let-off of draw force while maintaining a desired amount of energy stored by the bow at full draw. It may also be possible, for example, to generate a given amount of energy stored at full draw with a smaller range of rotation of the cam assemblies, or with a smaller degree of bow limb deflection. Other advantageous adaptations that may be enabled by securing the power cables to cam assemblies at both ends thereof shall fall within the scope of the present disclosure or appended claims.

The instantaneous rate of take-up or let-out of a journal or other mechanism is determined by the effective lever arm. At brace and early in the draw (FIGS. 3A and 4A), the lever arm of the power cable take-up journals 234*a*/234*b* are substantially larger than those of power cable let-out journals 236*a*/236*b*, resulting in net decrease in lengths of the power cables 245*a*/245*b* and deflection of the bow limbs 211*a*/211*b* toward one another. As the cam assemblies 230*a*/230*b* are rotated by unwinding of the draw cable 240 from the draw cable journals 232*a*/232*b*, the relative lever arms may change. In the exemplary cam assemblies of the Figures, the lever arm of the power cable let-out journals 236*a*/236*b* are substantially constant, while the lever arms of power cable take-up journals 234*a*/234*b* decrease. Embodiments having power cable let-out journals with varying lever arms shall also fall within the scope of the present disclosure or appended claims. The variation in lever arms (of the draw cable let-out as well as the power cable take-up and let-out) may be used to counteract the increasing force required to increasingly deflect the bow limbs and somewhat "flatten" the draw force curve. As the end of the draw length is neared (FIGS. 3B and 4B), the lever arm of the power cable take-up journals 234*a*/234*b* may decrease so that the draw force decreases, resulting in the desired let-off of the draw force. In the exemplary cam assemblies of the Figures, the take-up lever arm is only slightly larger near full draw than the let-out lever arm, resulting in relatively large let-off (over 80% let-off or more is readily obtainable). Since it is the relative lever arms that determine the overall draw force, virtually any desired degree of let-off may be obtained.

Some exemplary values for the ratios of the lever arms are given. A ratio at brace between a lever arm of the draw cable journals and a lever arm of the power cable take-up mechanisms may be between about 0.1:1 and about 1:1. A ratio at brace between the lever arm of the power cable take-up mechanisms and a lever arm of the power cable let-out mechanisms is between about 1.5:1 and about 20:1. A ratio at full draw between a lever arm of the draw cable journals and a lever arm of the power cable take-up mechanisms is between about 1:1 and about 6:1. A ratio at full draw between the lever arm of the power cable take-up mechanisms and a lever arm of the power cable let-out mechanisms is between about 1.1:1 and about 5:1. These are exemplary values that yield satisfactory bow performance, however, other values for the lever arm ratios may be employed while remaining within the scope of the present disclosure or appended claims. As described further hereinbelow, it is desirable to keep the ratio between the power cable take-up mechanisms and the power cable let-out mechanisms greater than 1:1 so as to avoid undesirable "cocking" of the bow.

Figure 8A:
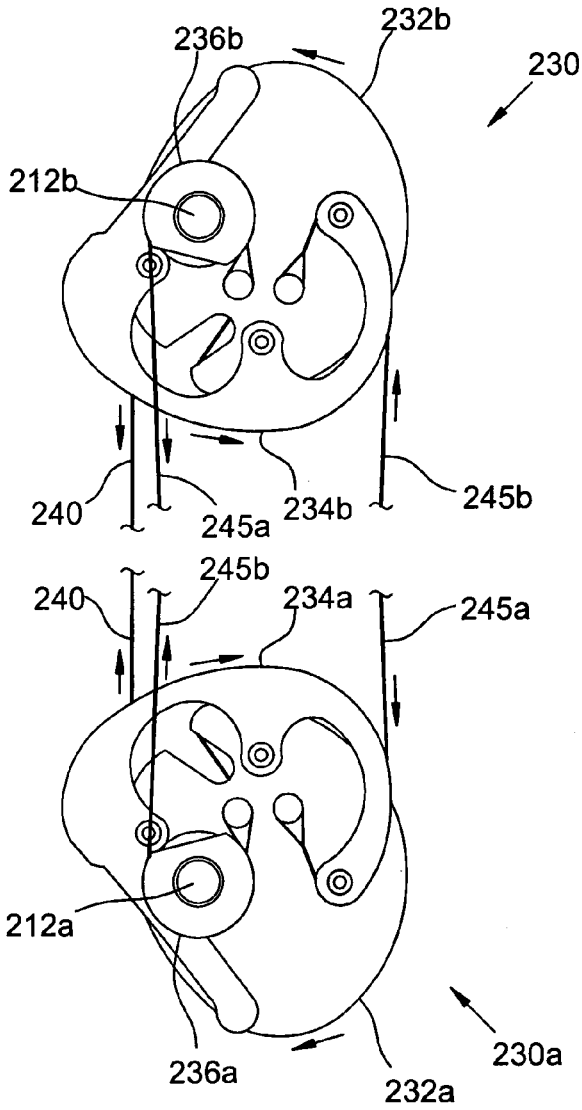
FIGS. 8A and 8B are schematic right side views of alternative cam assemblies at brace and at full draw, respectively.
Figure 8B:
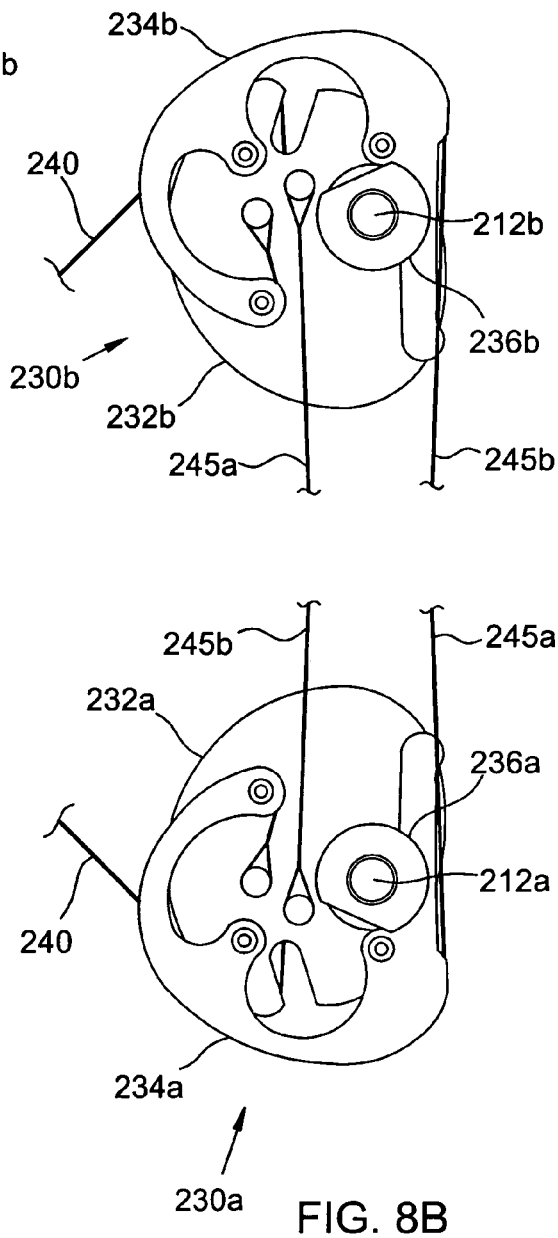
Figure 9A:
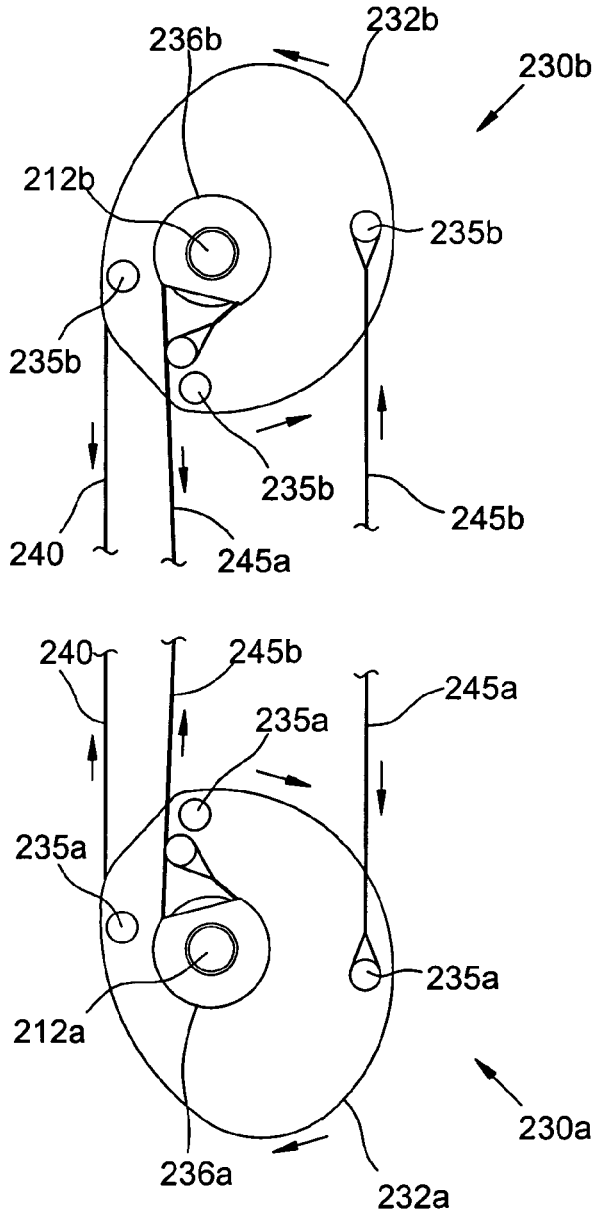
FIGS. 9A and 9B are schematic right side views of alternative cam assemblies at brace and at full draw, respectively.
Figure 9B:
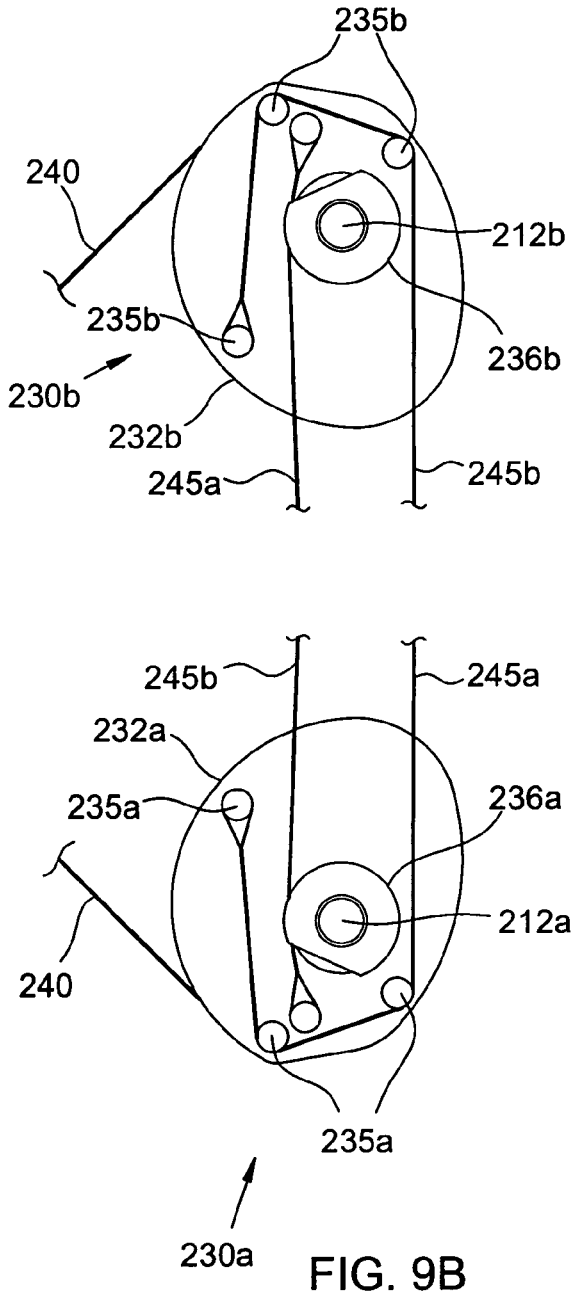

Other let-out or take-up mechanisms may be employed for power cables 245*a*/245*b*. Instead of power cable journals, for example, the power cables may wrap around one or more posts suitably positioned on the cam assembly. As part of a let-out mechanism, the power cable might begin wrapped around a journal or a post, whose distance from the axle determines the lever arm at any given rotation angle (FIG. 8A). As the cam assembly rotates, the power cable would eventually lose contact with the journal or post, and the lever arm would then be determined by the position of a next post or by the position of the cable anchor (FIG. 8B). Similarly, a take-up mechanism would bring one or more posts 235*a*/235*b* into contact with the power cable as the cam assembly rotates, and the position of the post(s) relative to the axle would determine the lever arm as the power cable is taken up (FIGS. 9A and 9B). These, as well as other suitable let-out or take-up mechanisms, shall fall within the scope of the present disclosure or appended claims.

The additional lever arm provided by power cable let-out journals 236*a*/236*b* enables manipulation of the draw force curve that might not be possible with prior art dual-cam bows. The additional design parameters introduced via the power cable let-out journals used in conjunction with the power cable take-up journals enable tailoring of the draw force curve for achieving a variety of potentially desirable design goals. These may include, but are not limited to: reduced limb deflection, increased stored energy, reduced cam rotation, greater let-off with negligible effect on accuracy, more rapid let-off, more abrupt "back-wall" of the draw force, decreased "virtual mass" (i.e., bow energy taken up for rotating the cams or for moving the bow limbs and the cams, and therefore unavailable for propelling the arrow). It has also been observed that synchronization of the cams is inherently achieved by securing the power cables to cam assemblies at both ends, instead of to a bow limb at one end and a cam assembly at the other. The cams may be regarded as substantially "cable-synchronized", although the present disclosure or appended claims shall encompass any dual-cam bow having power cables secured at both ends to cam assemblies, whether the cam assemblies are synchronized or not.

Figure 6A:
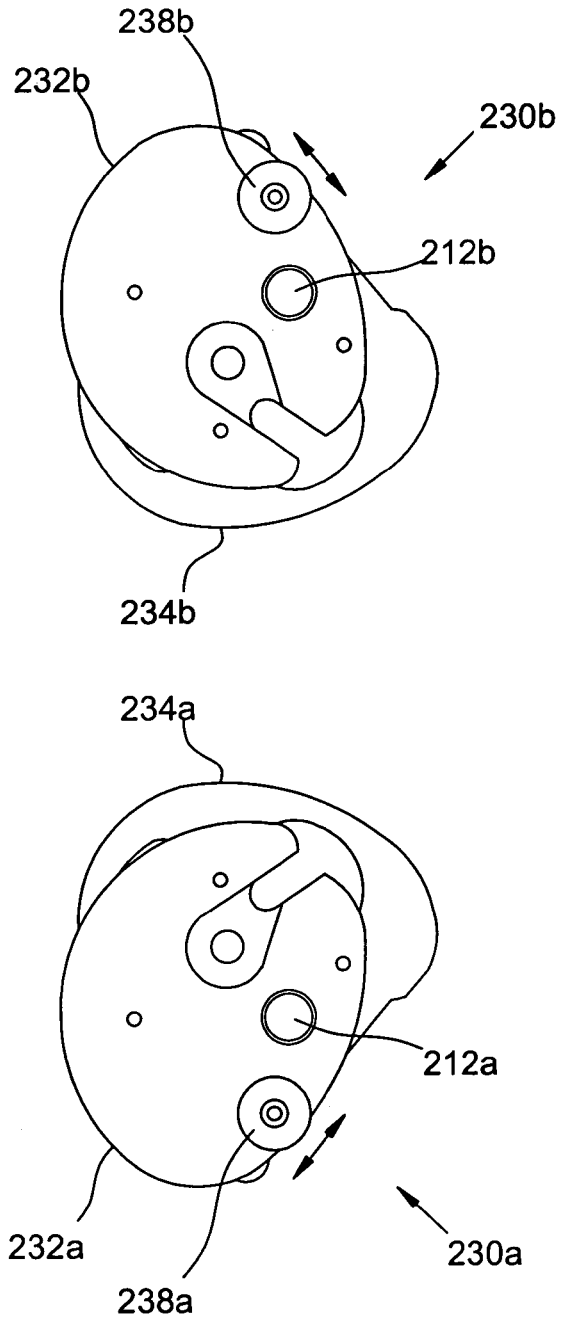
FIGS. 6A and 6B are schematic left side views of the cam assemblies of FIGS. 5A and 5B with the rotation stops in place and removed, respectively.
Figure 6B:
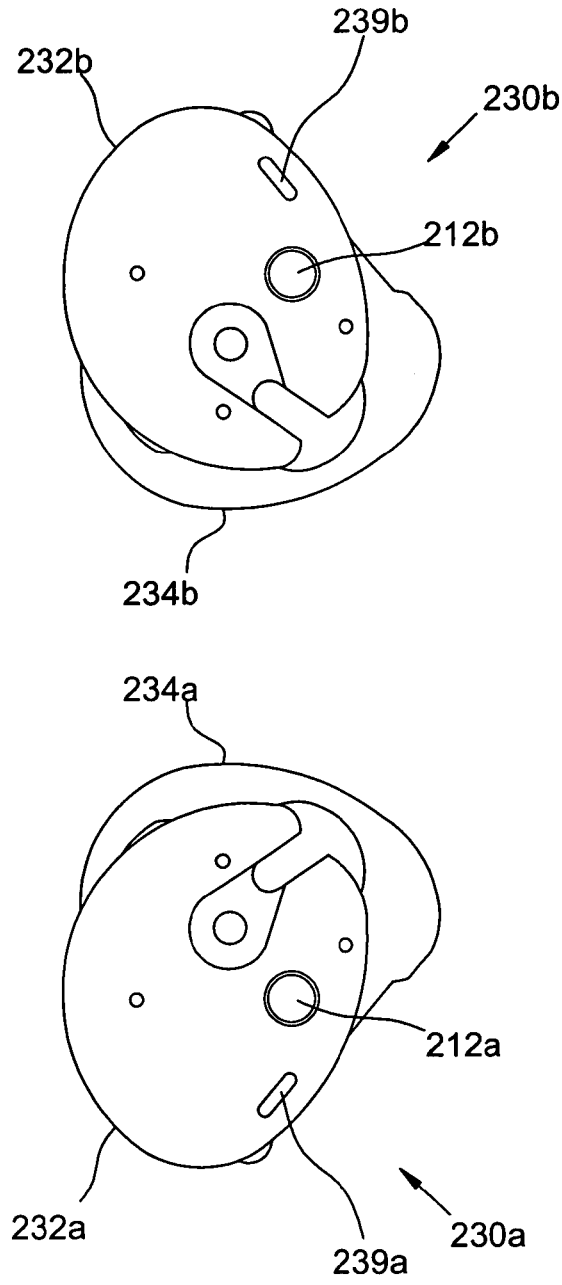

If the take-up lever arm decreases to become substantially equal to the let-out lever arm, the draw force goes to zero (100% let-off), the draw cable goes limp, and the bow is "cocked" in this position. Releasing the draw cable at this cocked point will not release the arrow, but instead the cam assemblies must be mechanically forced back to the 100% let-off point. To prevent this scenario, the cam assemblies may be arranged so that the ratio between the lever arms of the power cable take-up and let-out mechanisms remains greater than 1:1 throughout the draw of the bow. Alternatively, to avoid "cocking" of the bow or to allow a specific let-off or draw length to be substantially fixed, one or both cam assemblies 230*a*/230*b* may be provided with respective rotation stops 238*a*/238*b* (FIGS. 5A, 5*b*, 6A, and 6B). In the exemplary embodiments, the rotation stops 238*a*/238*b* may each comprise a simple peg or other protrusion secured to the cam assembly, that upon rotation eventually comes into contact with a bow limb, the draw cable, or a power cable (bow limbs in FIG. 5B). The rotation stops 238*a*/238*b* each may be secured to the respective cam assembly at a position chosen to limit cam assembly rotation to a desired value. The cam rotation limit may be chosen to for yielding a desired let-off, for yielding a desired draw length, or for another purpose. The rotation stop may be integrally formed with or permanently secured to the cam assembly. Alternatively, as illustrated in FIGS. 6A and 6B, the rotation stops 238*a*/238*b* may be adjustably secured to the cam assemblies (by means of slots 239*a*/239*b* in this example; any other suitable means may be employed within the scope of the present disclosure or appended claims). With such adjustable rotation stops, a given bow with a given set of cam assemblies and cables may be adjusted for varying the cam rotation, draw length, limb deflection, or let-off.

Figure 3A:
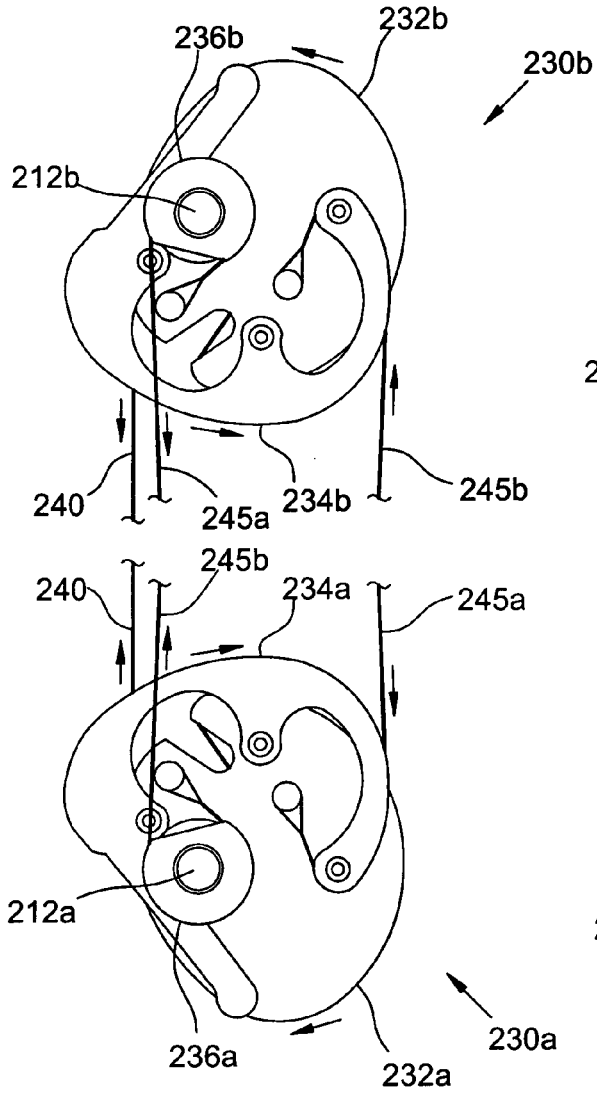
FIGS. 3A and 3B are schematic right side views of the cam assemblies of the bow of FIG. 2 at brace and at full draw, respectively.
Figure 3B:
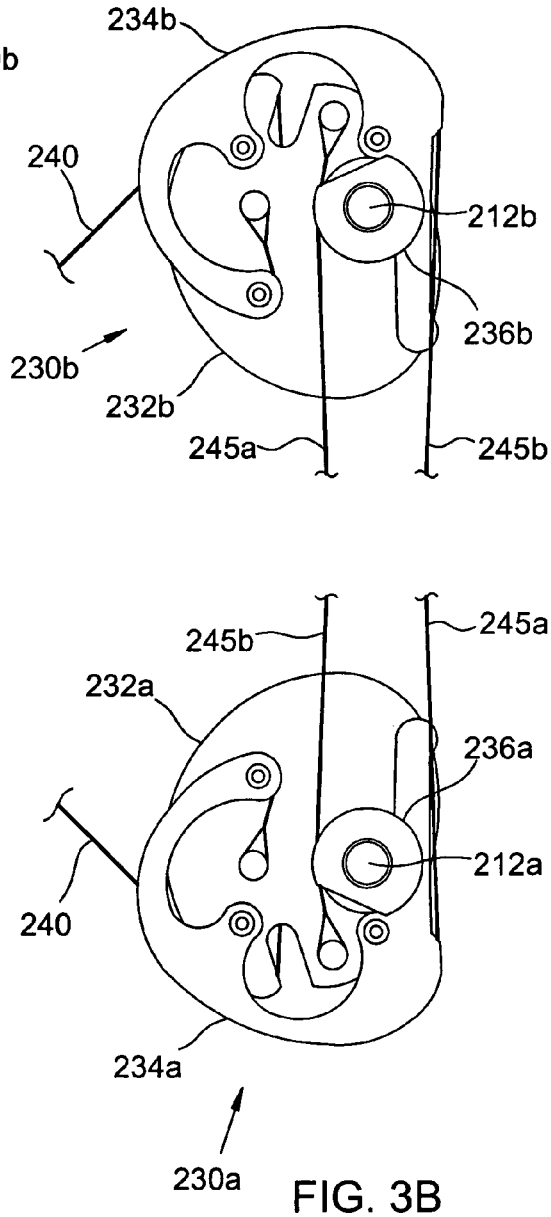
Figure 4A:
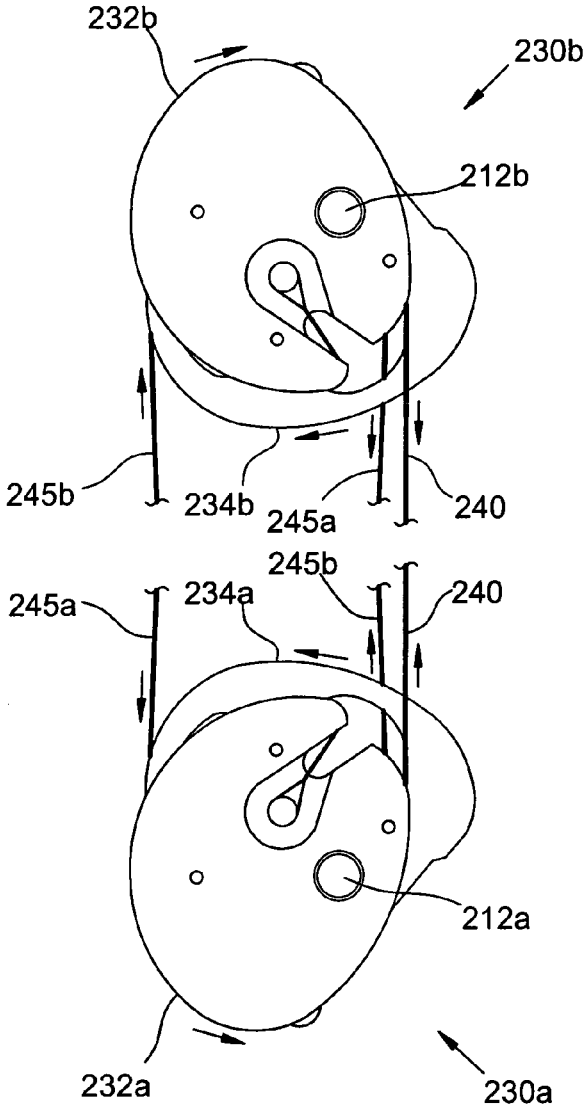
FIGS. 4A and 4B are schematic left side views of the cam assemblies of the bow of FIG. 2 at brace and at full draw, respectively.
Figure 4B:
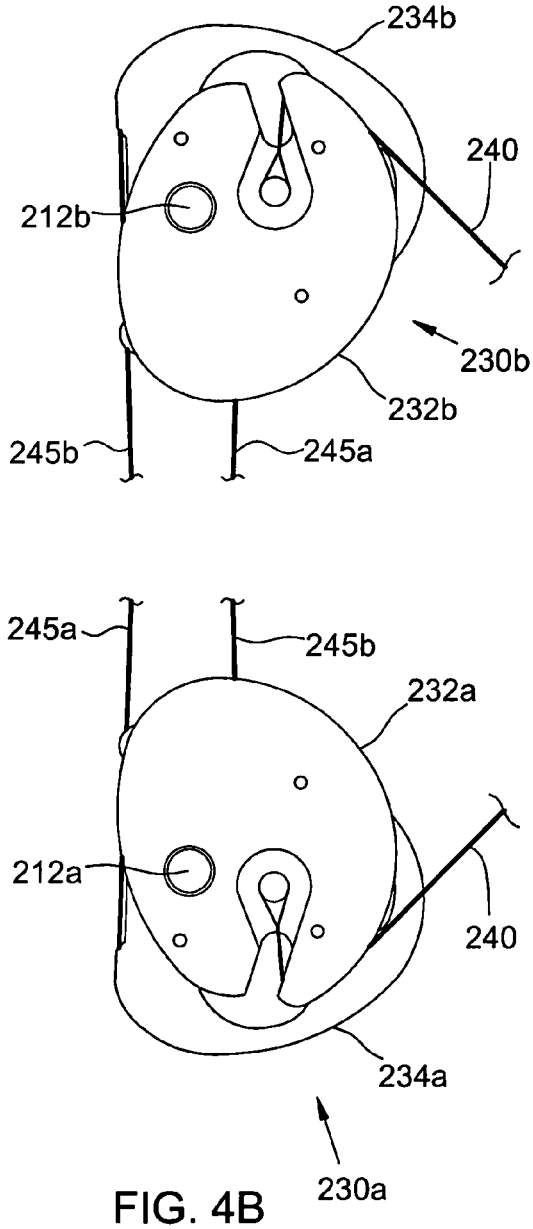
Figure 5A:
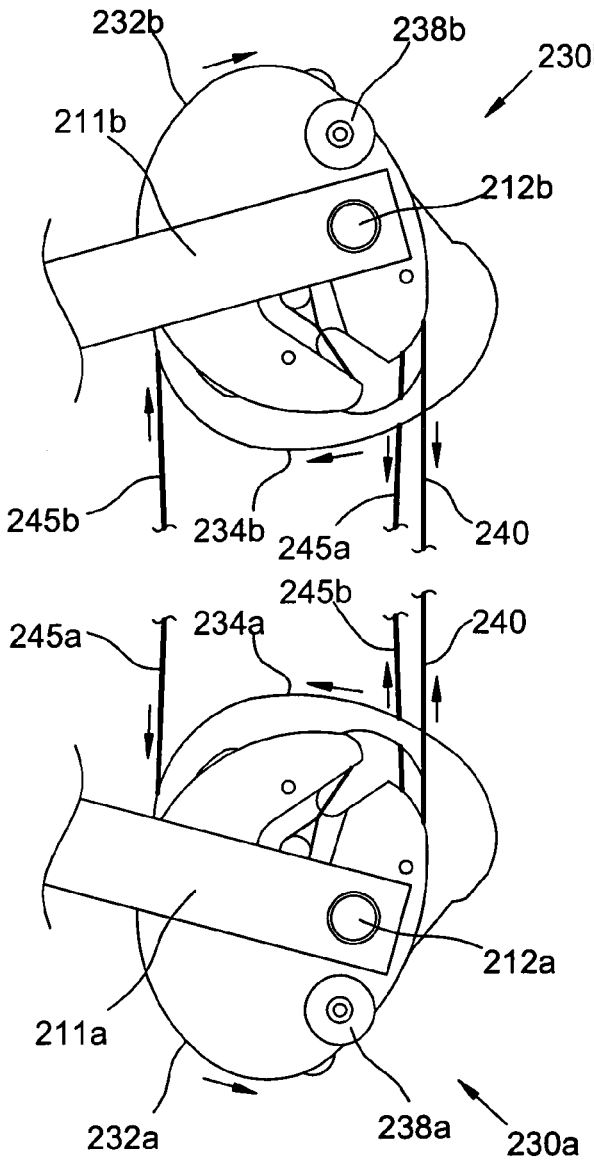
FIGS. 5A and 5B are schematic left side views of the cam assemblies of the bow of FIG. 2 at brace and at full draw, respectively, with rotation stops.
Figure 5B:
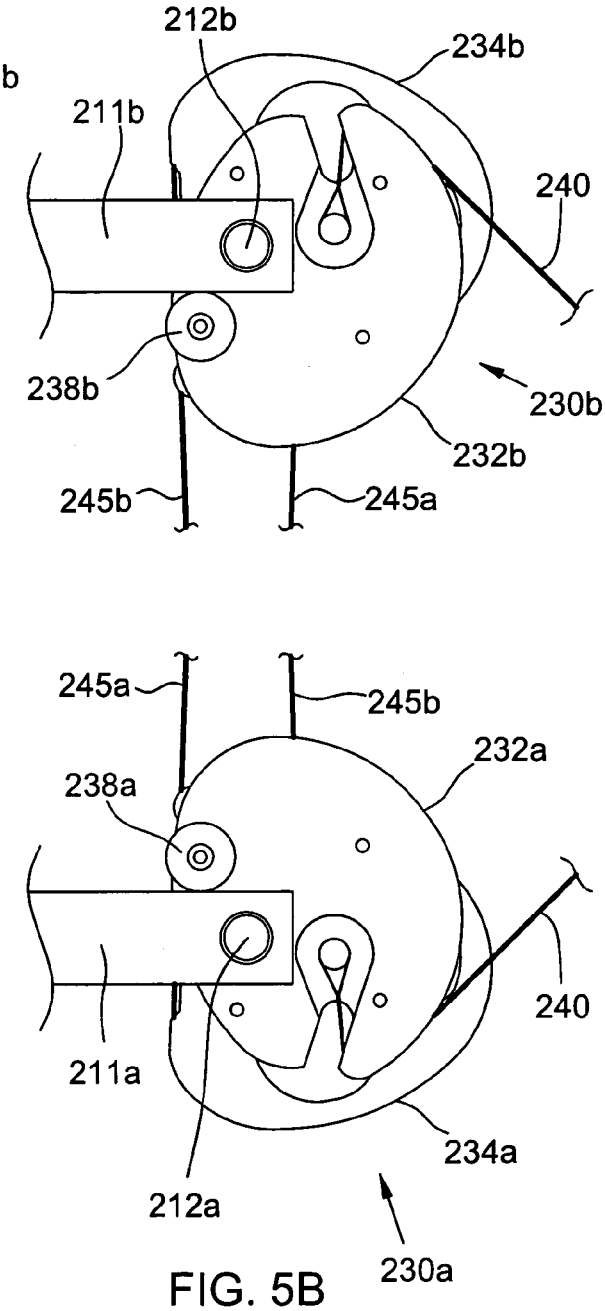
Figure 7A:
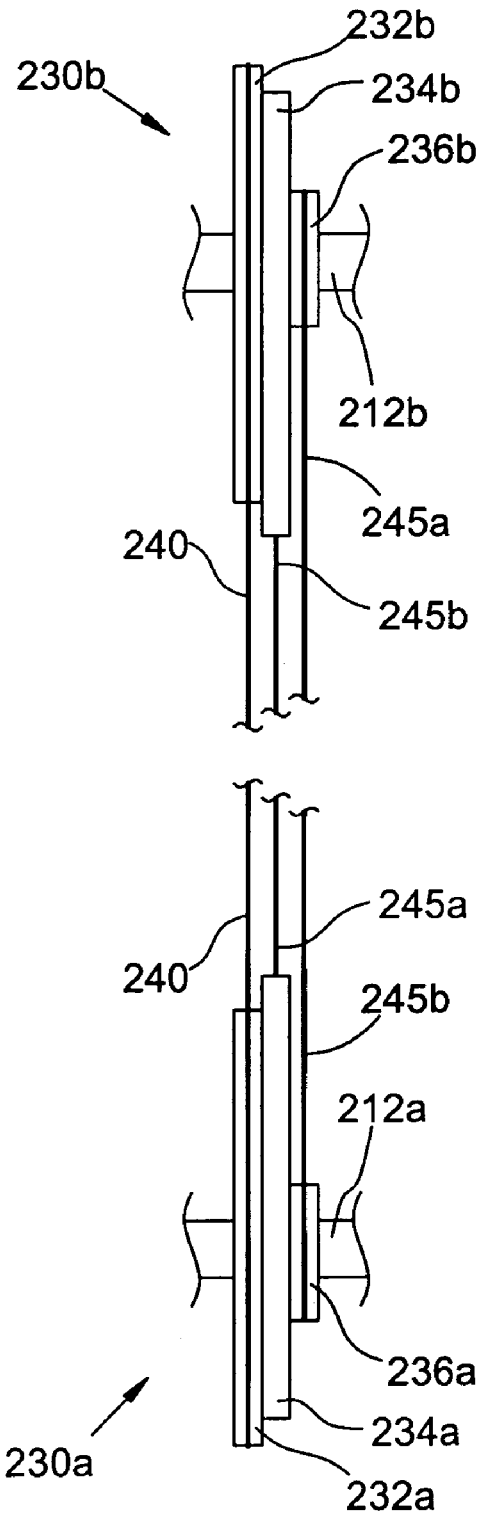
FIG. 7A is a schematic back view of the cam assemblies of FIGS. 3A and 4A.
Figure 7B:
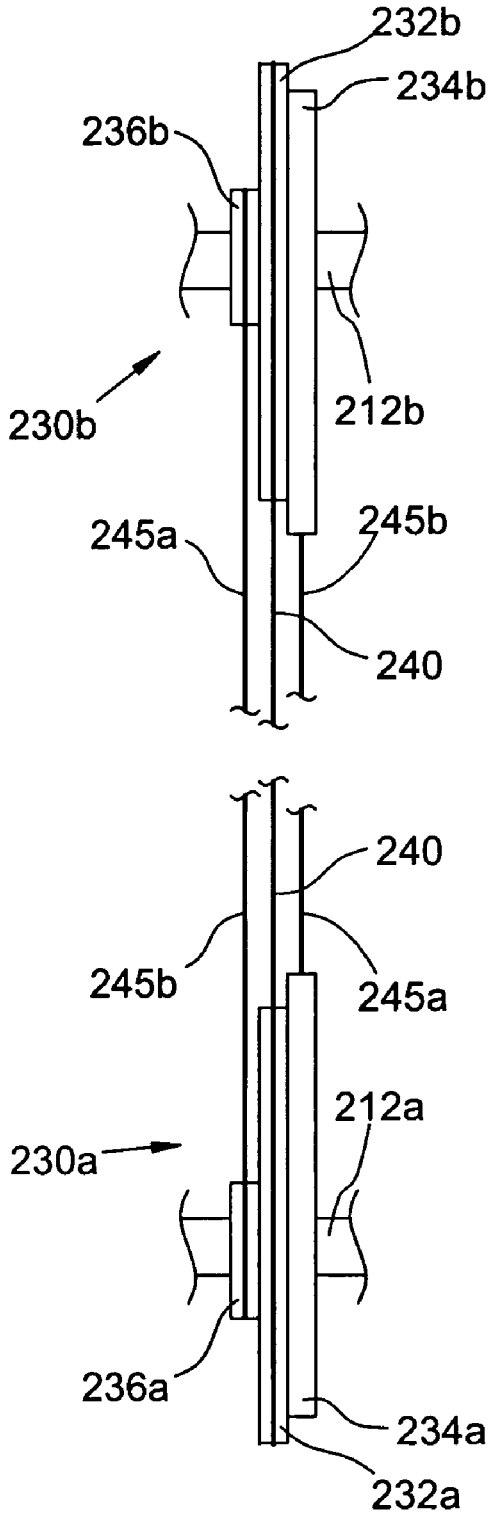
FIG. 7B is a schematic back view of alternative cam assemblies.

A back view of the exemplary cam assemblies of FIGS. 3A and 4A is shown in FIG. 7A, and shows that both power cables 245*a*/245*b* are on the same side of the cam assemblies. This is typically a satisfactory arrangement, but may result in torque exerted on the axles 212*a*/212*b*. A cable guard may be employed (not shown) that holds the power cables sideways out of the arrow path. Such a cable guard may hold both power cables to the same side of the arrow path, or might be adapted for holding the power cables on opposite sides of the arrow path (as long as the power cable take-up mechanisms are adapted so that the power cables do not rub against the side of the drawstring journals as the bow is drawn). An alternative arrangement of the cam assemblies is shown on FIG. 7B, in which the power cable take-up and let-out journals are arranged on opposite sides of the draw string journals, so that one power cable is on each side of the draw cable. Torque on the axles 212*a*/212*b* may be reduced or substantially eliminated by such an arrangement, which may be advantageous in certain circumstances. A cable guard (not shown) may be adapted for holding the power cables out of the arrow path on opposite sides when cam assemblies of FIG. 7B are used, or may be adapted for holding both power cables to the same side of the arrow path (as long as the power cable take-up mechanisms are adapted so that the power cables do not rub against the side of the drawstring journals as the bow is drawn).

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives. It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure or appended claims.

What is claimed is:

1. An archery bow, comprising:

a central handle portion;

a first flexible bow limb and a second flexible bow limb, the first and second bow limbs being mounted at opposite ends of and projecting substantially symmetrically from the handle;

a first cam assembly rotatably mounted on the first bow limb and comprising a draw cable journal, a power cable take-up mechanism, and a power cable let-out mechanism;

a second cam assembly rotatably mounted on the second bow limb and comprising a draw cable journal, a power cable take-up mechanism, and a power cable let-out mechanism;

a draw cable, the draw cable being secured at a first end thereof to the first cam assembly and received in the draw cable journal thereof, the draw cable being secured at a second end thereof to the second cam assembly and received in the draw cable journal thereof;

a first power cable, the first power cable being secured at a first end thereof to the first cam assembly and engaged with the power cable take-up mechanism thereof, the first power cable being secured at a second end thereof to the second cam assembly and engaged with the power cable let-out mechanism thereof; and a second power cable, the second power cable being secured at a first end thereof to the second cam assembly and engaged with the power cable take-up mechanism thereof, the second power cable being secured at a second end thereof to the first cam assembly and engaged with the power cable let-out mechanism thereof, wherein:

the first and second cam assemblies are arranged so that drawing the bow results in: (i) the draw cable being let out from the respective draw cable journals of the first and second cam assemblies, (ii) rotation of the first and second cam assemblies, (iii) the first end of the first power cable being taken up by the power cable take-up mechanism of the first cam assembly and the second end of the first power cable being let out by the power cable let-out mechanism of the second cam assembly, and (iv) the first end of the second power cable being taken up by the power cable take-up mechanism of the second cam assembly and the second end of the second power cable being let out by the power cable let-out mechanism of the first cam assembly;

draw force versus draw distance for the archery bow is at least in part determined by a rate of take-up of the first power cable by the first cam assembly relative to a rate of let-out of the first power cable by the second cam assembly, and by a rate of take-up of the second power cable by the second cam assembly relative to a rate of let-out of the second power cable by the first cam assembly; and the first and second cam assemblies are arranged so as to avoid 100% let-off of the draw force or so as to prevent cocking of the bow.

2. The archery bow of claim 1, wherein the first and second cam assemblies are substantial mirror images of one another.

3. The archery bow of claim 1, wherein:

the power cable take-up mechanism of the first cam assembly comprises a power cable take-up journal; and the power cable take-up mechanism of the second cam assembly comprises a power cable take-up journal.

4. The archery bow of claim 1, wherein:

the power cable let-out mechanism of the first cam assembly comprises a power cable let-out journal; and the power cable let-out mechanism of the second cam assembly comprises a power cable let-out journal.

5. The archery bow of claim 1, wherein:

at brace, the first power cable wraps around a post on the second cam assembly, the post comprising at least a portion of the power cable let-out mechanism of the second cam assembly; and at brace, the second power cable wraps around a post on the first cam assembly, the post comprising at least a portion of the power cable let-out mechanism of the first cam assembly.

6. The archery bow of claim 1, wherein the first cam assembly further comprises a rotation stop for limiting rotation of the first cam assembly as the bow is drawn, the rotation stop being positioned so as to avoid 100% let-off of the draw force or so as to prevent cocking of the bow.

7. The archery bow of claim 6, wherein the position of the rotation stop on the first cam assembly can be adjusted, thereby enabling adjustment of let-off of the draw force when the bow is drawn.

8. The archery bow of claim 1, wherein a ratio between a lever arm of the power cable take-up mechanisms and a lever arm of the power cable let-out mechanisms remains greater than 1:1 throughout drawing of the bow.

9. The archery bow of claim 8, wherein:

a ratio at brace between a lever arm of the draw cable journals and a lever arm of the power cable take-up mechanisms is between about 0.1:1 and about 1:1; and a ratio at brace between the lever arm of the power cable take-up mechanisms and a lever arm of the power cable let-out mechanisms is between about 1.5:1 and about 20:1.

10. The archery bow of claim 8, wherein:

a ratio at full draw between a lever arm of the draw cable journals and a lever arm of the power cable take-up mechanisms is between about 1:1 and about 6:1; and a ratio at full draw between the lever arm of the power cable take-up mechanisms and a lever arm of the power cable let-out mechanisms is between about 1.1:1 and about 5:1.

11. The archery bow of claim 1, wherein:

the first cam assembly is arranged so that the power cable take-up and let-out mechanisms thereof are on opposite sides of the draw cable journal thereof;

the second cam assembly is arranged so that the power cable take-up and let-out mechanisms thereof are on opposite sides of the draw cable journal thereof; and the arrangement of the power cable take-up and let-out mechanisms on opposite sides of their respective cam assemblies substantially eliminates twisting of the bow limbs due to torque applied by the power cables as the bow is drawn.

12. A cam assembly for an archery bow, comprising:

a draw cable journal for letting out a draw cable as the bow is drawn and the cam assembly rotates, the cam assembly being adapted for being rotatably mounted on a limb of the archery bow;

a power cable take-up mechanism for taking up a first power cable as the bow is drawn and the cam assembly rotates; and a power cable let-out mechanism for letting out a second power cable as the bow is drawn and the cam assembly rotates, wherein:

draw force versus draw distance for the archery bow is at least in part determined by a rate of take-up of the first power cable by the cam assembly relative to a rate of let-out of the second power cable by the cam assembly; and the cam assembly is arranged so as to avoid 100% let-off of the draw force or so as to prevent cocking of the bow.

13. The apparatus of claim 12, further comprising a second cam assembly, the second cam assembly comprising:

a draw cable journal for letting out the draw cable as the bow is drawn and the second cam assembly rotates, the second cam assembly being adapted for being rotatably mounted on a second limb of the archery bow;

a power cable take-up mechanism for taking up the second power cable as the bow is drawn and the second cam assembly rotates; and a power cable let-out mechanism for letting out the first power cable as the bow is drawn and the second cam assembly rotates, wherein:

the draw force versus the draw distance for the archery bow is at least in part determined by a rate of take-up of the first power cable by the cam assembly relative to a rate of let-out of the first power cable by the second cam assembly, and by a rate of take-up of the second power cable by the second cam assembly relative to a rate of let-out of the second power cable by the cam assembly; and the second cam assembly is arranged so as to avoid 100% let-off of the draw force or so as to prevent cocking of the bow; and the cam assemblies are substantial mirror images of one another.

14. The cam assembly of claim 12, wherein the power cable take-up mechanism of the cam assembly comprises a power cable take-up journal.

15. The cam assembly of claim 12, wherein the power cable let-out mechanism of the cam assembly comprises a power cable let-out journal.

16. The cam assembly of claim 12, wherein at brace, the second power cable wraps around a post on the cam assembly, the post comprising at least a portion of the power cable let-out mechanism of the cam assembly.

17. The cam assembly of claim 12, wherein the cam assembly further comprises a rotation stop for limiting rotation of the cam assembly as the bow is drawn, the rotation stop being positioned so as to avoid 100% let-off of the draw force or so as to prevent cocking of the bow.

18. The cam assembly of claim 17, wherein the position of the rotation stop on the cam assembly may be adjusted, thereby enabling adjustment of let-off of the draw force when the bow is drawn.

19. The cam assembly of claim 12, wherein a ratio between a lever arm of the power cable take-up mechanism and a lever arm of the power cable let-out mechanism remains greater than 1:1 throughout drawing of the bow.

20. The cam assembly of claim 19, wherein:

a ratio at brace between a lever arm of the draw cable journal and a lever arm of the power cable take-up mechanism is between about 0.1:1 and about 1:1; and a ratio at brace between the lever arm of the power cable take-up mechanism and a lever arm of the power cable let-out mechanism is between about 1.5:1 and about 20:1.

21. The cam assembly of claim 19, wherein:

a ratio at full draw between a lever arm of the draw cable journal and a lever arm of the power cable take-up mechanism is between about 1:1 and about 6:1; and a ratio at full draw between the lever arm of the power cable take-up mechanism and a lever arm of the power cable let-out mechanism is between about 1.1:1 and about 5:1.

22. The cam assembly of claim 12, wherein the cam assembly is arranged so that the power cable take-up and let-out mechanisms are on opposite sides of the draw cable journal so as to substantially eliminate twisting of the bow limb due to torque applied by the power cables as the bow is drawn.

* * * * *